US006517601B1

(12) United States Patent
Nakano et al.

(10) Patent No.: US 6,517,601 B1
(45) Date of Patent: Feb. 11, 2003

(54) THREE-DIMENSIONAL CAM AND PRODUCTION METHOD THEREOF

(75) Inventors: Shuuji Nakano, Nagoya (JP); Yoshihiko Masuda, Okazaki (JP); Yoshihito Moriya, Nagoya (JP); Hideo Nagaosa, Nishikamo-gun (JP); Shinichiro Kikuoka, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 106 days.

(21) Appl. No.: 09/654,270

(22) Filed: Sep. 1, 2000

(30) Foreign Application Priority Data

Sep. 21, 1999 (JP) ..... 11-267031

(51) Int. Cl.[7] ..... B22F 3/12; C22C 1/04
(52) U.S. Cl. ..... 75/228; 419/38
(58) Field of Search ..... 419/38; 75/228

(56) References Cited

U.S. PATENT DOCUMENTS

| | | | | |
|---|---|---|---|---|
| 4,664,706 A | | 5/1987 | Drozda | |
| 4,763,614 A | | 8/1988 | Burgio di Aragona | |
| 4,851,189 A | * | 7/1989 | Donch et al. | 419/28 |
| 5,009,123 A | | 4/1991 | Hiraoka et al. | |
| 5,082,433 A | * | 1/1992 | Leithner | 419/11 |
| 5,273,710 A | * | 12/1993 | Zengin | 419/47 |
| 5,659,873 A | * | 8/1997 | Seyrkammer | 419/29 |
| 6,000,368 A | | 12/1999 | Mikame | |

FOREIGN PATENT DOCUMENTS

| | | |
|---|---|---|
| DE | 41 18 003 A1 | 12/1991 |
| EP | 0 892 156 A1 | 1/1999 |
| JP | 10-44014 | 2/1998 |
| JP | 11-36831 | 2/1999 |
| JP | 11-36832 | 2/1999 |
| JP | 11-165248 | 6/1999 |

* cited by examiner

*Primary Examiner*—Daniel J. Jenkins
(74) *Attorney, Agent, or Firm*—Oliff & Berridge, PLC

(57) ABSTRACT

A three-dimensional cam has a cam profile surface shape that changes along a rotating axis of the cam, and is produced by net-shape-sintering. The sintered density of a sintering material at the time of net-shape-sintering is set to 7 to 7.4 g/cm$^3$ to achieve a hole rate of the cam profile surface within the range of 5 to 10%. The three-dimensional cam has an improved durability, while securing high productivity.

16 Claims, 2 Drawing Sheets

THREE-DIMENSIONAL CAM AND PRODUCTION METHOD THEREOF

INCORPORATION BY REFERENCE

The disclosure of Japanese Patent Application No. 11-267031 filed on Sep. 21, 1999, including the specification, drawings and abstract is incorporated herein by reference in its entirety.

BACKGROUND OF THE INVENTION

1. Field of the Invention

The invention relates to a three-dimensional cam having a profile shape that varies along a rotating axis thereof, and a production method for the cam.

2. Description of Related Art

In order to improve the performance of internal combustion engines, continuously variable valve apparatus have recently been proposed that change valve characteristics, such as amount of lift, open/close timing, open valve period, etc., of engine valves, based on the three-dimensional configurations of cams.

Internal combustion engines equipped with variable valve apparatus as described above employ, as cams for opening and closing engine valves, three-dimensional cams having cam profile shapes that continuously vary along their rotating axes. By moving a camshaft connected to such a three-dimensional cam in a direction of the rotating axis thereof by hydraulic pressure or the like, the apparatus changes the cam profile shape in contact with a valve lifter of the engine valve. In accordance with changes of contact cam profile, changes occur in the open/close timing, the open/close amount, the open/close duration, etc., of the intake or exhaust valve driven by the valve lifter.

Since the cam profile shape of a three-dimensional cam varies along the rotating axis, high-precision processing of the cam profile surface of the cam is very difficult. For example, if a cam profile surface is machined by grinding with a grindstone as described in Japanese Patent Application Laid-Open No. 10-44014, complicate process steps and an increased process time are needed in order to secure a sufficient precision.

Therefore, a three-dimensional cam is formed through integral molding by a powder metallurgy (i.e., net-shape-sintering). The net-shape-sintering allows highly efficient production of three-dimensional cams having complicated cam profile shapes while securing sufficient precision.

In general, cams used for opening and closing engine valves of internal combustion engines, not confined to three-dimensional cams, are required to have high durability against damage, such as slide abrasion, pitting and like, because these cams are rotated at high speeds while being pressed against valve lifters by valve springs of the engine valves and therefore receive high surface pressures. Particularly, three-dimensional cams used in a continuously variable valve apparatus need to have further high durability because the cams also are moved in the direction of the rotating axis during operation of the internal combustion engine.

Although cams formed by the aforementioned net-shape-sintering process have higher durability than normally employed cast cams, a further improvement in durability is desired because operation of cams in even more severe conditions is demanded in order to improve the performance of internal combustion engines.

SUMMARY OF THE INVENTION

The invention has been accomplished in view of the aforementioned circumstances. It is an object of the invention to provide a three-dimensional cam having a cam profile that varies along (i.e., in the direction of) its rotating axis, and a production method for the cam that allow a further improvement in durability while securing high productivity.

To achieve the aforementioned and/or other objects, a three-dimensional cam according to a first aspect of the invention has a cam profile that varies along a rotating axis, and is produced by net-shape-sintering. The cam profile surface has holes at a proportion of 5 to 10% relative to the total area of the cam profile surface.

Net-shape-sintering, that is, integral formation by powder metallurgy, is able to form a three-dimensional cam having a complicated cam profile with a high form precision, without necessitating a machining process, and therefore is able to secure a high productivity. Since the three-dimensional cam is produced by net-shape-sintering, the construction of the first aspect of the invention is able to improve productivity while securing sufficient precision of the three-dimensional cam.

Furthermore, according to the first aspect, the three-dimensional cam produced by net-shape-sintering has, in its cam profile surface, holes at a hole rate of 5 to 10%. The hole rate of a three-dimensional cam surface can be appropriately adjusted by setting the sintered density for the net-shape-sintering process. The term "hole rate" as used herein is the proportion of the total hole area to the surface area of the cam profile surface expressed in percentage.

The presence of holes contributes to an improvement in lubricant retention because a lubricant, such as an oil or the like, enters the holes. Therefore, an increase in the hole rate further reduces the friction on the cam profile surface, that is, further improves the friction characteristic of the cam, so that slide abrasion can be more effectively curbed.

An increase in the hole rate also increases the roughness of the cam profile surface, so that the resistance to pitting decreases. However, the present inventors have ascertained that if the hole rate is within the range of 5 to 10%, a sufficient pitting resistance can be attained while the friction is curbed within a permissible magnitude (see FIG. 2). Therefore, according to the first aspect, it is possible to achieve a further improved durability in the three-dimensional cam having a cam profile that changes along the rotating axis, while securing a high productivity.

In accordance with a second aspect of the invention, in a method for producing a three-dimensional cam having a cam profile shape that changes along a rotating axis by net-shape-sintering, a sintered density for the net-shape-sintering is set to about 7 to 7.4 grams per cubic centimeter.

As described above, net-shape-sintering is able to produce a three-dimensional cam with a high productivity while securing a sufficiently high precision in forming the three-dimensional cam. Furthermore, since a surface of the three-dimensional cam produced by the net-shape-sintering has holes at a hole rate of 5 to 10%, a high durability is secured.

In the production method of the second aspect of the invention, a sintering material for the net-shape-sintering is compacted so that the density of the sintering material, that is, the sintered density, becomes 7 to 7.4 grams per cubic centimeter. According to this production method, a frame mold having a molding surface for molding a shape of the three-dimensional cam is filled with a material powder of the three-dimensional cam. The material powder is pressmolded by the frame mold into the shape of the three-dimensional cam at a density of about 7 to 7.4 grams per cubic centimeter. The molded body is sintered at a predetermined temperature. If the three-dimensional cam is produced by the above-described production method, the hole rate of the surface of the three-dimensional cam can be set to 5 to 10%.

If the net-shape-sintering is performed at a sintered density as mentioned above, the hole rate of a surface of the three-dimensional cam can be set to 5 to 10%.

Therefore, according to the second aspect, it is possible to produce a high-durability three-dimensional cam while securing a sufficiently high productivity.

In the three-dimensional cam production method of the second aspect of the invention, when the three-dimensional cam is removed from the frame mold during the net-shape-sintering, the mold withdrawal direction may be set to such a direction that the frame mold and the cam profile surface do not slidingly contact each other.

If the cam profile surface of a three-dimensional cam rubs against a frame mold when the three-dimensional cam is removed from the frame mold during production of the three-dimensional cam by net-shape-sintering, external edge portions of holes on the cam profile surface may deform so that holes formed by the sintering may be crushed. As a result, the hole rate decreases, so that a desired hole rate may not be achieved.

Therefore, if the three-dimensional cam is removed from the frame mold by withdrawing the frame mold in such a direction that the frame mold and the cam profile surface do not slidingly contact each other, a desired hole rate can always be achieved and, therefore, a high-durability three-dimensional cam can be produced with an even higher quality.

BRIEF DESCRIPTION OF THE DRAWINGS

The foregoing and further objects, features and advantages of the invention will become apparent from the following description of a preferred embodiment with reference to the accompanying drawings, wherein like numerals are used to represent like elements and wherein.

DETAILED DESCRIPTION OF PREFERRED EMBODIMENTS

An embodiment in which the three-dimensional cam and the production method for the cam of the invention are embodied will be described in detail with reference to the drawings.

Figure 1A:
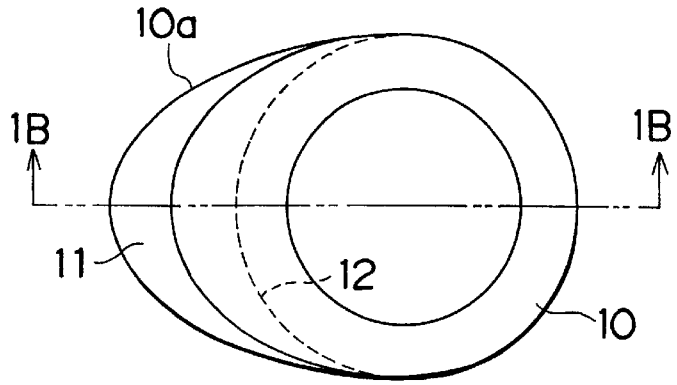
FIG. 1A is a plan view illustrating a configuration of a three-dimensional cam according to an embodiment of the invention.
Figure 1B:
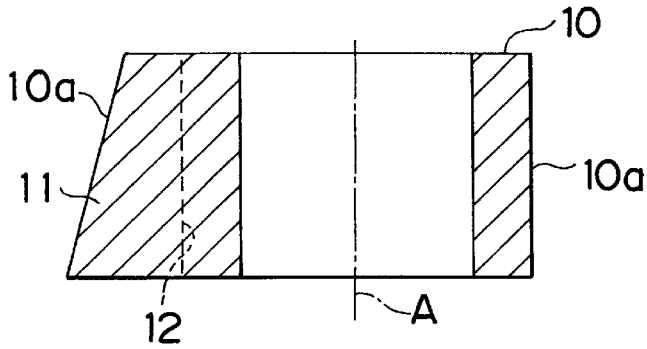
FIG. 1B is a sectional view illustrating a sectional shape of the cam taken along line 1B—1B in FIG. 1A.
Figure 1C:
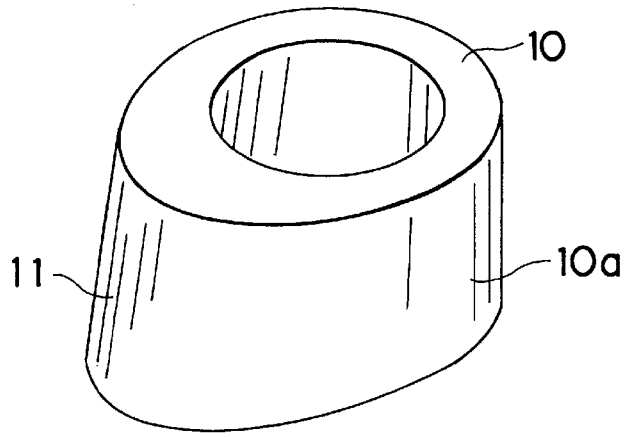
FIG. 1C is a perspective view illustrating the configuration of the three-dimensional cam of the embodiment of the invention.

FIG. 1A illustrates a planar structure of a three-dimensional cam of one embodiment of the invention. FIG. 1B illustrates a sectional view of the cam taken along line 1B—1B in FIG. 1A. FIG. 1C illustrates a perspective view of the cam.

As shown in FIGS. 1A to 1C, the three-dimensional cam 10 has a cam profile shape that varies along (i.e., in the direction of) a rotating axis A thereof. That is, the profile of the cam at the bottom of FIG. 1B is different from the profile at the top of FIG. 1B. In the cam 10, the diameter of a base circle 12 is consistent, and the height of a cam nose 11 changes along the rotating axis A.

In this embodiment, the three-dimensional cam 10 is produced by net-shape-sintering. More specifically, the three-dimensional cam 10 is produced by compacting a powder-form sintering material in a frame mold, and thereby forming it into a shape as indicated above, and sintering it. If such a net-shape-sintering process is employed to produce a cam, a sufficiently high processing precision can be secured without a need to perform a machining process, such as grinding or the like. Therefore, the net-shape-sintering increases the productivity even if the product is the three-dimensional cam 10 as described above.

As a sintering material of the three-dimensional cam 10, a sintering material that is excellent in abrasion resistance, for example, a compound material containing 0.6% by weight of Mo, 0.2% by weight of Mn, and 0.8% by weight of C relative to a main material Fe, preferably is used.

In the case of production by net-shape-sintering, holes are formed in gaps between powder particles of the sintering material. For example, if the particle size of the sintering material is about 0.1 mm, holes of several micrometers to 50 micrometers are formed in surfaces of the three-dimensional cam 10. The amount of holes can be adjusted based on the degree of compaction of the sintering material during the net-shape-sintering process. That is, if the sintering material is compacted at an increased pressure and therefore the density (sintered density) is increased, the amount of holes decreases. If the sintered density is reduced, the amount of holes increases.

In this embodiment, the abrasion resistance characteristic of the three-dimensional cam 10 is improved by suitably adjusting the hole rate of a cam profile surface 10*a* (percentage of the total area of holes to the surface area).

Figure 2:
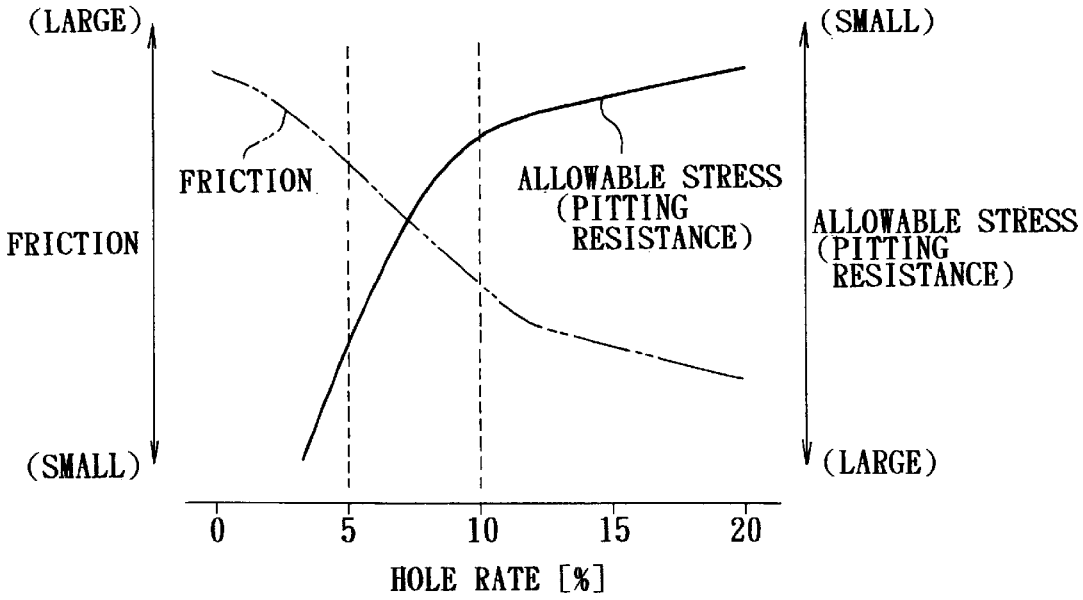
FIG. 2 is a schematic diagram indicating relationships of the hole rate with the friction and with the allowable stress with respect to pitting.

FIG. 2 indicates relationships of the hole rate of the cam profile surface 10*a* with the friction and the pitting on the cam profile surface occurring during operation of the three-dimensional cam 10.

As indicated in FIG. 2, the friction on the cam profile surface 10*a* decreases with increases in the hole rate. This is explained as follows. That is, since lubricant, such as an oil or the like, enters holes, an increased hole rate improves lubricant retention of the cam profile surface 10*a*. However, if the hole rate is increased, the cam profile surface 10*a* becomes rougher, so that pitting more readily occurs. Therefore, the allowable stress of the cam profile surface 10*a* with respect to pitting decreases with increases in the hole rate.

Thus, an increase in the hole rate improves the friction performance of the three-dimensional cam 10, but reduces the pitting resistance. For example, if the hole rate is increased from 0% to 5%, the friction on the cam profile surface 10*a* decreases by about 10%. However, if the hole rate is increased from 10% to 13%, the allowable stress with respect to pitting falls by about 30%.

Therefore, in order to achieve both good friction characteristic and good pitting resistance characteristic of the three-dimensional cam, it is desirable to set the hole rate of the cam profile surface 10*a* within the range of 5 to 10%. In application to a direct impact-type valve driving mechanism, cams are required to have a particularly good friction characteristic because the cams slidingly contact valve lifters. The range of hole rate of 5% to 10% sufficiently satisfies such a severe friction characteristic requirement and, at the same time, secures a needed pitting resistance characteristic.

Therefore, the three-dimensional cam 10 of this embodiment is produced so that the hole rate of the cam profile surface 10*a* is within the range of 5 to 10%. The hole rate of the cam profile surface 10*a* can be set within the range of 5 to 10% by, for example, setting the sintered density of a sintering material during the net-shape-sintering process within the range of 7 to 7.4 grams per cubic centimeter. For example, the hole rate is achieved to approximately 10% when the sintered density is set to 7 grams per cubic centimeter. The hole rate is achieved to approximately 5% when the sintered density is set to 7.4 grams per cubic centimeter.

Even if holes are formed in a cam profile surface to a suitable degree, performance of a grinding process following the sintering process will crush holes, so that a desired hole rate may not be achieved. With regard to the sintering-net-shaped three-dimensional cam 10, however, the sintering process alone secures a sufficiently high precision, so that it may only be necessary to perform an additional step of a coated abrasive working process having a stock removal of merely about 2 to 3 $\mu$m. The additional step to such a minor extent does not crush, but substantially maintains, holes formed by the sintering process, so that a desired hole rate can easily be secured.

Figure 3:
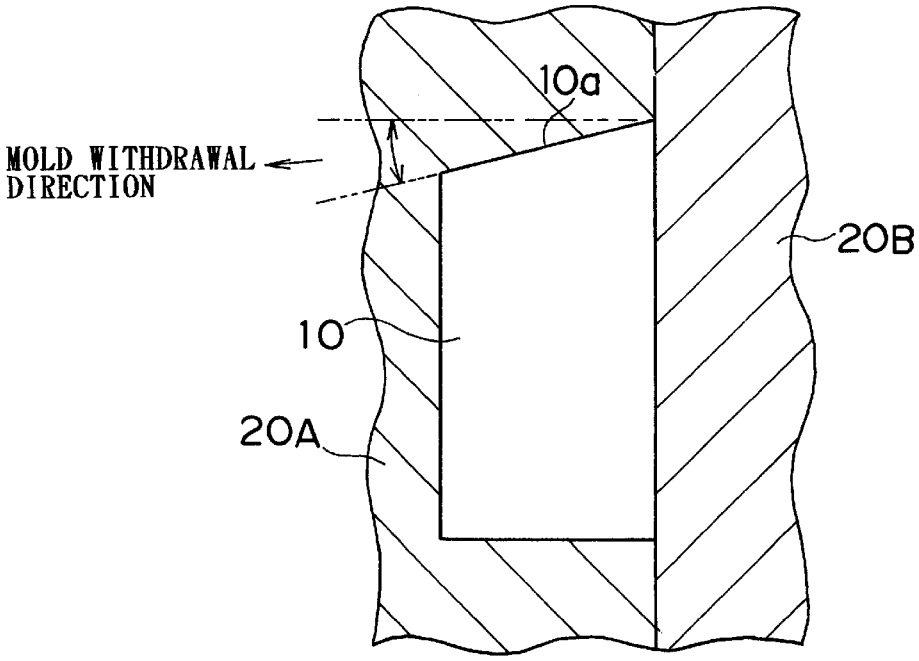
FIG. 3 is a sectional view illustrating a three-dimensional cam and its frame mold during net-shape-sintering.

If the sintered three-dimensional cam 10 is removed from the frame mold before sufficiently cooling and hardening, holes may be crushed as the cam profile surface 10*a* of the three-dimensional cam 10 and a frame mold surface rub against each other. In the embodiment, therefore, a direction of withdrawing a frame mold from the three-dimensional cam 10 is set such that the frame mold and the cam profile surface 10*a* do not slidingly contact each other. For example, if a three-dimensional cam 10 is formed by two frame molds 20A, 20B as shown in FIG. 3, the frame mold 20A is withdrawn in a direction within a range indicated by arrows in FIG. 3, so that the frame mold 20A can be withdrawn without rubbing against the cam profile surface 10*a*.

As described above, the three-dimensional cam and the production method for the cam of this embodiment achieve the following advantages:

(1) In the embodiment, the three-dimensional cam 10, having a cam profile that varies along the rotating axis and produced by net-shape-sintering, has a hole rate of the cam profile surface 10*a* within the range of 5 to 10%. Therefore, it is possible to achieve a good friction characteristic and a good pitting resistance characteristic of a three-dimensional cam having a cam profile that changes along the rotating axis, and therefore improve the durability of the cam while securing a high productivity.

(2) In the embodiment, with regard to the net-shape-sintering of the three-dimensional cam 10, the sintered density is set within 7–7.4 grams per cubic centimeter. Therefore, it is possible to secure a hole rate of the cam profile surface 10*a* that achieves a good friction characteristic and a good pitting resistance characteristic.

(3) In the embodiment, after the net-shape-sintering of the three-dimensional cam 10, the three-dimensional cam 10 is removed from the frame molds 20A, 20B in such a direction that the cam profile surface 10*a* and the frame mold 20A do not slidingly contact each other. Therefore, crushing of holes due to rubbing against the frame mold 20A is avoided, so that a desired hole rate can be appropriately secured.

The three-dimensional cam and the production method for the cam of the embodiment described above may be modified as follows.

In the embodiment, the mold withdrawal direction at the time of net-shape-sintering is set to such a direction that the cam profile surface 10*a* and the frame mold 20A do not slidingly contact each other, as in an example shown in FIG. 3. However, the mold withdrawal direction is not limited to the direction exemplified in FIG. 3. If in accordance with the structure of frame molds used or the structure of a three-dimensional cam 10, an appropriate mold withdrawal direction is selected such that the frame molds do not rub against the cam profile surface, an advantage similar to the advantage (3) can be achieved.

Furthermore, even if the mold withdrawal direction is not set to such a direction that the cam profile surface and the frame mold do not slidingly contact, advantages similar to the advantages (1) and (2) can still be achieved provided that after the mold withdrawal, an appropriate hole rate is secured in the cam profile surface.

Although the embodiment is described in conjunction with a three-dimensional cam in which the diameter of the base circle 12 is consistent and the height of the cam nose 11 changes along the rotating axis A, this exemplary three-dimensional cam structure does not limit the invention. The construction and the production method of the invention are applicable to any three-dimensional cam as long as the cam is a three-dimensional cam having a cam profile that changes along its rotating axis, for example: a three-dimensional cam wherein the height of the cam nose is consistent and the base circle diameter varies along the rotating axis; a three-dimensional cam wherein two cam noses for main lift and sub-lift are provided and the height of at least one of the cam noses varies, and the like.

While the invention has been described with reference to preferred embodiments thereof, it is to be understood that the invention is not limited to the disclosed embodiments or constructions. To the contrary, the invention is intended to cover various modifications and equivalent arrangements.

What is claimed is:

1. A production method for a three-dimensional cam having a cam profile shape that changes along a rotating axis of the cam, comprising:

net-shape-sintering a material powder of the three-dimensional cam at a sintered density of 7 to 7.4 grams per cubic centimeter to produce the three-dimensional cam; and after the net-shape-sintering, removing the three-dimensional cam from a frame mold in such a direction that sliding contact between the frame mold and a cam profile surface of the cam is avoided.

2. A production method for a three-dimensional cam having a cam profile shape that changes along a rotating axis of the cam, comprising:

net-shape-sintering a material powder of the three-dimensional cam at a sintered density of 7 to 7.4 grams per cubic centimeter to produce the three-dimensional cam, the net-shape-sintering step including:

filling a frame mold having a molding surface for molding a shape of the three-dimensional cam, with the material powder of the three-dimensional cam;

forming a molded body by press-molding the material powder into the shape of the three-dimensional cam at a density of 7 to 7.4 grams per cubic centimeter with the frame mold; and sintering the molded body; and after the sintering step, removing the three-dimensional cam from the frame mold in such a direction that sliding contact between the frame mold and a cam profile surface of the cam is avoided.

3. A production method for a three-dimensional cam according to claim 2, wherein after the removing step, the cam has a cam profile surface having holes at a proportion 5% to 10% relative to a total surface area of the cam profile surface.

4. A production method for a three-dimensional cam according to claim 1, wherein after the net-shape-sintering, the cam has a cam profile surface having holes at a proportion 5% to 10% relative to a total surface area of the cam profile surface.

5. A production method for a three-dimensional cam according to claim 1, wherein the material powder is a compound material containing 0.6% by weight of Mo, 0.2% by weight of Mn and 0.8% by weight of C relative to a main material Fe.

6. A three-dimensional cam made by the production method of claim 1.

7. A production method for a three-dimensional cam according to claim 2, wherein the material powder is a compound material containing 0.6% by weight of Mo, 0.2% by weight of Mn and 0.8% by weight of C relative to a main material Fe.

8. A production method for a three-dimensional cam according to claim 3, wherein the material powder is a compound material containing 0.6% by weight of Mo, 0.2% by weight of Mn and 0.8% by weight of C relative to a main material Fe.

9. A three-dimensional cam made by the production method of claim 3.

10. A three-dimensional cam made by the production method of claim 7.

11. A three-dimensional cam made by the production method of claim 8.

12. A three-dimensional cam made by the production method of claim 2.

13. A production method for a three-dimensional cam according to claim 4, wherein the material powder is a compound material containing 0.6% by weight of Mo, 0.2% by weight of Mn and 0.8% by weight of C relative to a main material Fe.

14. A three-dimensional cam made by the production method of claim 13.

15. A three-dimensional cam made by the production method of claim 5.

16. A three-dimensional cam made by the production method of claim 4.

* * * * *